US008111858B2

(12) United States Patent
Sapiejewski

(10) Patent No.: US 8,111,858 B2
(45) Date of Patent: Feb. 7, 2012

(54) SUPRA-AURAL HEADPHONE NOISE REDUCING

(75) Inventor: Roman Sapiejewski, Boston, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 12/576,699

(22) Filed: Oct. 9, 2009

(65) Prior Publication Data

US 2010/0027803 A1 Feb. 4, 2010

Related U.S. Application Data

(62) Division of application No. 11/139,045, filed on May 27, 2005, now abandoned.

(51) Int. Cl.
*H04R 25/00* (2006.01)

(52) U.S. Cl. ..... 381/372; 381/71.6; 381/370; 381/371

(58) Field of Classification Search ..... 381/370–373, 381/182

See application file for complete search history.

(56) References Cited

U.S. PATENT DOCUMENTS

| | | | | |
|---|---|---|---|---|
| 1,498,727 | A | 6/1924 | Haskel | |
| 1,514,152 | A | 11/1924 | Gernsback | |
| 2,622,159 | A | 12/1952 | Herman | |
| 2,714,134 | A | 7/1955 | Touger et al. | |
| 3,272,926 | A | 9/1966 | Falkenberg | |
| 3,644,939 | A | 2/1972 | Beguin | |
| 3,645,354 | A * | 2/1972 | Kliewer | 181/129 |
| 4,005,267 | A | 1/1977 | Gorike et al. | |
| 4,027,117 | A * | 5/1977 | Nakamura | 381/372 |
| 4,058,688 | A * | 11/1977 | Nishimura et al. | 381/372 |
| 4,160,135 | A * | 7/1979 | Gorike | 381/373 |
| 4,455,675 | A * | 6/1984 | Bose et al. | 381/74 |
| 4,529,058 | A | 7/1985 | Emery | |
| 4,572,324 | A | 2/1986 | Fidi et al. | |
| 4,644,581 | A | 2/1987 | Sapiejewski | |
| 4,669,129 | A | 6/1987 | Chance | |
| 4,809,811 | A | 3/1989 | Gorike | |
| 4,893,695 | A * | 1/1990 | Tamura et al. | 181/151 |
| 4,922,542 | A | 5/1990 | Sapiejewski | |
| 5,020,163 | A * | 6/1991 | Aileo et al. | 2/209 |
| 5,134,659 | A | 7/1992 | Moseley | |
| 5,182,774 | A | 1/1993 | Bourk | |
| 5,208,868 | A | 5/1993 | Sapiejewski | |
| 5,343,523 | A | 8/1994 | Bartlett et al. | |
| 5,353,523 | A | 10/1994 | Kilgore et al. | |
| 5,729,605 | A | 3/1998 | Bobisuthi et al. | |
| 5,913,178 | A | 6/1999 | Olsson | |
| 5,970,160 | A * | 10/1999 | Nilsson et al. | 381/371 |

(Continued)

FOREIGN PATENT DOCUMENTS

CN 1101203 A 4/1995

(Continued)

OTHER PUBLICATIONS

European Search Report dated Jul. 16, 2007, issued in European Patent Application No. 06114353.3, filed May 22, 2006.

(Continued)

*Primary Examiner* — Curtis Kuntz
*Assistant Examiner* — Ryan Robinson

(57) ABSTRACT

An earphone for a supra-aural noise reducing headphone, with a front cavity that includes a foam portion and an open passageway. The foam portion supplements the volumetric dimension of the passageway to improve passive attenuation.

10 Claims, 3 Drawing Sheets

U.S. PATENT DOCUMENTS

| | | | | |
|---|---|---|---|---|
| 5,979,593 | A | 11/1999 | Rice et al. | |
| 6,567,525 | B1 * | 5/2003 | Sapiejewski | 381/71.6 |
| 6,597,792 | B1 | 7/2003 | Sapiejewski et al. | |
| 6,831,984 | B2 * | 12/2004 | Sapiejewski | 381/71.6 |
| 6,894,835 | B2 | 5/2005 | Ohsako et al. | |
| 7,103,188 | B1 | 9/2006 | Jones | |
| 7,853,034 | B1 * | 12/2010 | Gresko | 381/372 |
| 2009/0180657 | A1 * | 7/2009 | Isvan | 381/371 |
| 2010/0105447 | A1 * | 4/2010 | Sibbald et al. | 455/570 |

FOREIGN PATENT DOCUMENTS

| | | | |
|---|---|---|---|
| CN | 1213262 | A | 4/1999 |
| CN | 1297321 | A | 5/2001 |
| DE | 2547926 | | 5/1976 |
| DE | 3212519 | C1 | 1/1991 |
| EP | 0582404 | A2 | 2/1994 |
| EP | 0688143 | A2 | 12/1995 |
| EP | 0873040 | A2 | 10/1998 |
| EP | 1075164 | | 2/2001 |

OTHER PUBLICATIONS

Office Action dated Apr. 24, 2009, issued in China Application No. 200610084225.5.
Extended Search Report dated Apr. 9, 2009 in EP 09152605.3-1249.
Bullock, International Trade Commission, Joint Notice of Prior Art for US 5181252 and US6597792, Apr. 21, 2008.
Public Version of Joint Motion to Terminate Investigation dated Dec. 1, 2008.
Commission Notice of Determination dated Jan. 2, 2009.
Examination Report dated Mar. 10, 2008 for EP 05113070.6.
Translation of DE 003212519C1.
The extended European Search Report in corresponding European application dated Apr. 9, 2009.
Joint Notice of Prior Art for U.S. Patent 5,181,252 and U.S. Patent 6,597,792,United States International Trade Commission, Washington, D.C. 20436, Honorable Charles E. Bullock, Administrative Law Judge, Dated Apr. 21, 2008.
CN Office Action dated Jun. 22, 2010 for CN 200410097494.6.
CN Office Action dated Oct. 9, 2010 for CN 200610084225.5.
European Patent No. 1075164, FR and DE designated, granted Sep. 13, 2006.
European Patent No. 104314, designating FR and DE, granted Oct. 28, 2009.
Chinese Patent No. 00121656.2 granted Apr. 30, 2008.
Translation of Japanese Office Action in couterpart Application No. 2000-214735 dated Nov. 17, 2009, 5 pages.
CN Office Action dated Mar. 24, 2010 for CN 200610084225.5.
CN Office Action dated May 27, 2011 for CN Appln. 200610084225.5.
Response to CN Office Action dated May 27, 2011 for CN Appln. 200610084225.5.

* cited by examiner

SUPRA-AURAL HEADPHONE NOISE REDUCING

This application is a Divisional Application of, and claims priority of, U.S. patent application Ser. No. 11/139,045 incorporated by reference in its entirety.

BACKGROUND

This specification describes a noise reducing headphone and more particularly a noise reducing supra-aural headphone. Supra-aural headphones are discussed in U.S. Pat. No. 6,567,525. According to a supra-aural design, each earphone has a cushion that rests on the ear when the headphone is being worn by the user. Supra-aural headphones are typically lightweight, compact, and comfortable. However supra-aural headphones have not been as popular as other headphone designs, particularly circum-aural headphones, for high performance noise reduction headphones and particularly for active noise reduction headphones. Circum-aural headphones, which are typically larger than supra-aural headphones, have larger front cavities (which will be discussed below) which aids in passive noise attenuation. Additionally, circum-aural headphones can seal against the side of the head, which aids in passive noise attenuation. Sealing against a relatively even surface, like the side of the head, is simpler than sealing against an uneven surface, such as the ear. For that reason, there typically needs to be more sealing surface in a supra-aural headphone than sealing surface in a circum-aural headphone.

SUMMARY

In one aspect of the invention an earphone for a supra-aural headphone earphone includes a cup-shaped shell and a cushion mounted to the shell. The cushion includes a portion of an acoustically open foam having an inside surface and an outside surface, the inside surface defining and acoustically coupled to a passageway. The passageway has a cross-sectional area and a volumetric dimension. The earphone also includes a cushion cover of a high acoustic impedance material enclosing a portion of the outside surface of the portion of foam, wherein the cushion cover and the shell define an interior volume having a volumetric dimension. The earphone further includes a baffle assembly, including a baffle plate. An acoustic driver having a diaphragm is mounted in the baffle plate. The baffle assembly is mounted in the earphone to divide the interior enclosed volume into a front enclosed volume portion and a rear enclosed volume portion. The front enclosed volume portion includes the passageway and the foam. The volumetric dimension of the front enclosed volume is greater than 10 cc and wherein the volumetric dimension of the passageway is less than 10 cc. The earphone is constructed and arranged to be positioned against the ear of a user so that the passageway acoustically couples the diaphragm to the user's ear canal.

The passageway cross-sectional area may be smaller than the acoustic driver radiating surface area. The volumetric dimension of the front volume may be about 25 cc, and wherein the volumetric dimension of the passageway may be about 5 cc. The foam may be a fully reticulated, slow recovery material. The rear enclosed volume portion may be acoustically coupled to the environment by an acoustic mass and an acoustic resistance in parallel. The passageway may have an elongated cross-sectional shape.

In another aspect of the invention, an earphone for an active noise reduction headset, includes a generally planar baffle having two surfaces, with an opening therethrough; a first enclosed volume portion, that includes the first baffle surface, a foam structure having two generally planar surfaces and sides and an opening therethrough. The opening has two ends. The first planar surface of the foam structure mounted against the first baffle surface so that the baffle opening may be adjacent the first end of the cushion opening. The foam structure opening may be acoustically coupled to the foam structure. The earphone may further include a cushion cover of acoustically closed material, covering the second planar surface of the foam structure, except for the second end of the cushion opening. The earphone may also include a second enclosed volume portion that includes the second baffle surface, and a cup-shaped shell. The cushion cover may be constructed and arranged to seal against the external portion of a user's ear.

The earphone may further include an acoustic driver, mounted in the baffle opening. The volumetric dimension of the cushion passageway may be less than 10 cc. The volumetric dimension of the cushion passageway may be about 5 cc. The volumetric dimension of the foam structure may be about 20 cc. The rear enclosed volume portion may be acoustically coupled to the environment by an acoustic volume and an acoustic resistance in parallel. The foam structure opening may have an elongated shape in cross section. The foam structure opening may have a racetrack shape in cross section. The foam structure planar surfaces have an elongated shape. The foam structure planar surfaces may have an oval shape.

In yet another aspect of the invention, an earphone for an active noise reduction headset, includes an acoustic driver, a volume having a volumetric dimension, enclosed by high acoustical impedance material, acoustically coupling the acoustic driver and a user's ear and sealed to the user's ear. The earphone also has an open passageway between the acoustic driver and the ear inside the volume. The open passageway has a volumetric dimension. The earphone also has a portion of substantially acoustically open foam in the volume. The foam having a volumetric dimension. The foam is acoustically coupled to the passageway so that the volumetric dimension of the foam significantly acoustically increases the volumetric dimension of the passageway to better passively attenuate noise that enters the volume. The foam volumetric dimension is greater than the passageway volumetric dimension. The foam volumetric dimension may be more than twice the volumetric dimension of the passageway. The foam volumetric dimension may be more than four times the volumetric dimension of the passageway. The volumetric dimension of the foam may be 25 cc and the volumetric dimension of the passageway may be 5 cc.

BRIEF DESCRIPTION OF THE SEVERAL VIEWS OF THE DRAWING

Other features, objects, and advantages will become apparent from the following detailed description, when read in connection with the following drawing, in which.

DETAILED DESCRIPTION

Figure 1:
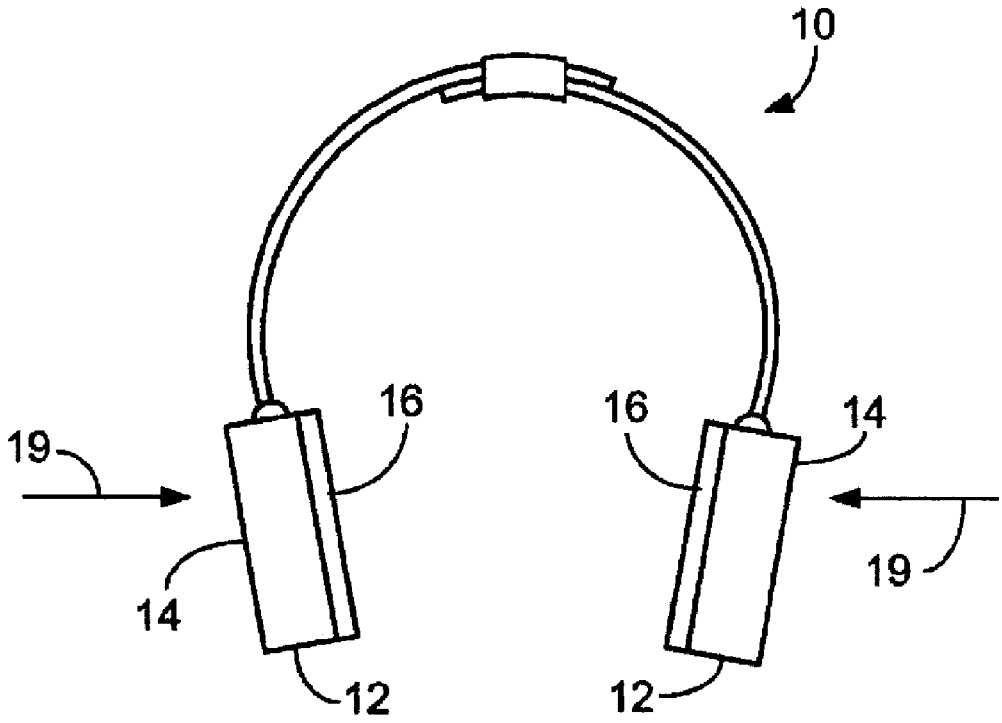
FIG. 1 is a front plan view of a supra-aural headphone.

Referring to FIG. 1, there is shown a supra-aural headphone 10. The headphone includes two earphones 12, connected by a headband. Each earphone 12 includes a cup shaped shell 14 and a cushion 16. The headband 17 exerts a force in an inward direction as represented by arrows 19.

Figure 2B:
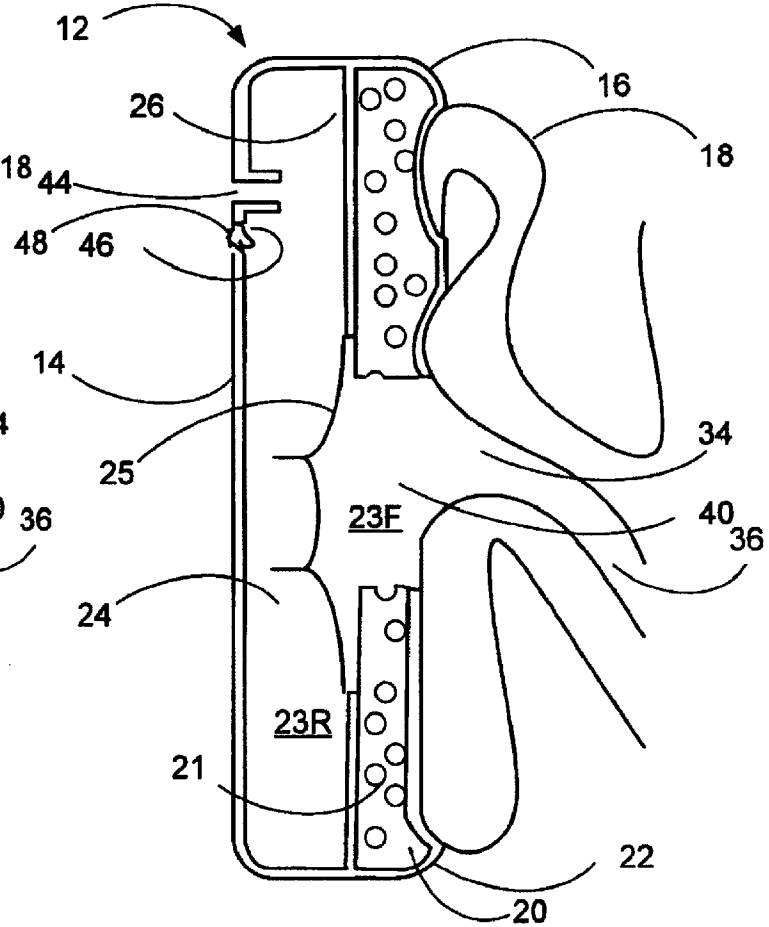
FIGS. 2A and 2B are cross-sectional views of an earphone.
Figure 2A:
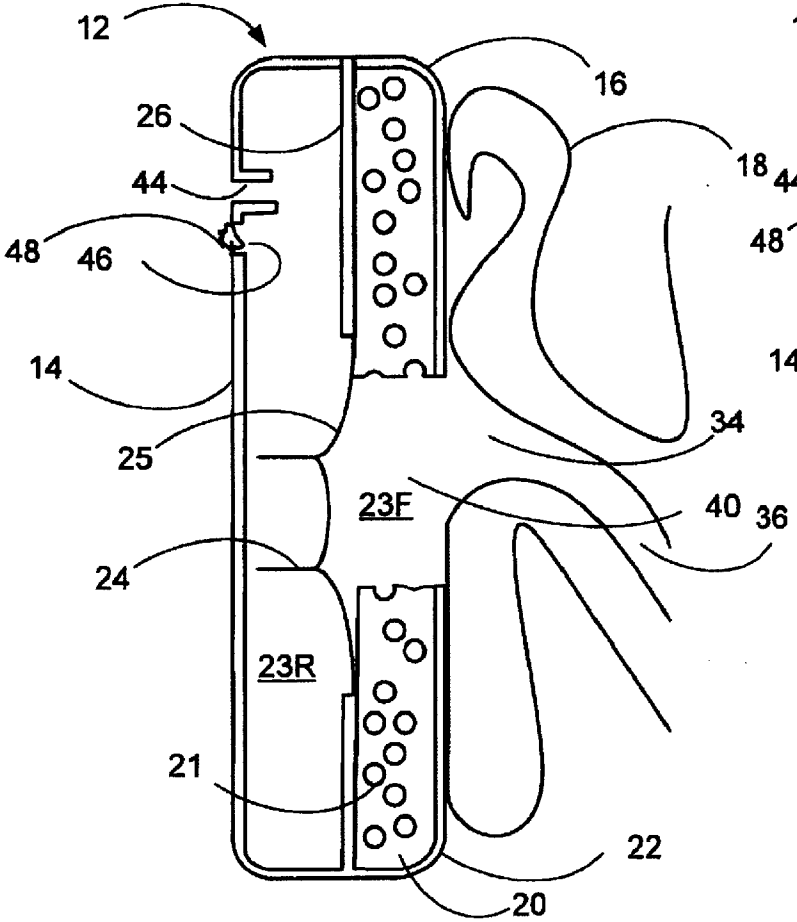

FIGS. 2A and 2B show a side cross-sectional view of an earphone 12 in position against a user's ear. The cushion 16 deforms slightly (FIG. 2B) to form a seal against the user's ear 18. The seal significantly reduces the amplitude of external acoustic energy reaching the concha 34 and the ear canal 36 of the user.

The cushion 16 includes a foam portion 20 and a cushion cover 22. The foam portion 20 is made of a type of foam that is acoustically open, that is, it is capable of propagating pressure waves. A suitable type of foam is a fully reticulated, slow recovery foam such as CFNT foam, supplied by the E-A-R Specialty Composites business unit of Aeraro Company of Indianapolis, Ind. In the figure, air cells 21 are shown to indicate that the material is foam but do not represent to actual structure of the foam. The shell portion 14 may be made of a rigid and plastic having high acoustic impedance such as an ABS plastic. Together, the shell 14 and the cushion cover enclose an interior volume 23.

An acoustic driver 24 is mounted in a baffle 26. The acoustic driver 24 includes a diaphragm 25. The baffle 26 and the diaphragm 25 separate the enclosed internal volume 23 into a front enclosed volume portion 23F and a rear enclosed volume portion 23R. The front enclosed volume portion includes a passageway 40 that acoustically couples the diaphragm 25 to the concha 34 and the ear canal 36 of the user's ears without creating a significant pressure gradient between the ear and the diaphragm, as would an earphone that acoustically couples the diaphragm with a user's ear through a foam portion. The foam portion 20 is acoustically coupled to the passageway 40 and is sufficiently acoustically open that it volumetrically supplements the passageway 40 and therefore increases the volumetric dimension of the front enclosed volume portion 23F. The volumetric dimension of foam portion 20 is greater, and preferably much greater, for example greater than four times, the volumetric dimension of the passageway 40. In one embodiment, the total volumetric dimension of the front enclosed volume portion may be in the range of 30 cc, of which 5 cc is the passageway 40 and 25 cc is the foam portion 20 The passageway 40 may have a smaller cross-sectional area than the diaphragm 25. The cushion cover 22 has high acoustic impedance, so sound waves passing through the cushion cover are significantly attenuated. The cushion cover 22 forms a seal with a user's ear and forms a portion of a boundary of the enclosed acoustic volume 23. A suitable material for the cushion cover is protein leather. The opening 42 between the passageway and the concha 34 may be covered with an acoustically transparent material to protect the diaphragm and to prevent debris from entering the interior of the earphone. The rear enclosed volume portion 23R may be acoustically coupled to the environment by an acoustic mass, such as acoustic port 44 and an acoustically resistive opening 46, as described in U.S. Pat. No. 6,894,835. The acoustic resistance in the acoustically resistive opening could be a portion of polyester material, as shown in FIGS. 2A and 2B, or may be a wire mesh, or some other acoustically resistive material.

An earphone in which the foam acoustically open to the passageway, supplements the volumetric dimension of the passageway, and is greater, preferably significantly greater, than the volumetric dimension of the passageway is advantageous because the front enclosed volume can be larger than the front enclosed volume of conventional headphones, while still providing a large compliant surface to provide a good seal with the ear. Such an earphone is especially advantageous for supra-aural headphones, because the earphone can be made relatively small while having the large front enclosed volume for passive noise attenuation and the large compliant sealing surface.

Figure 3:
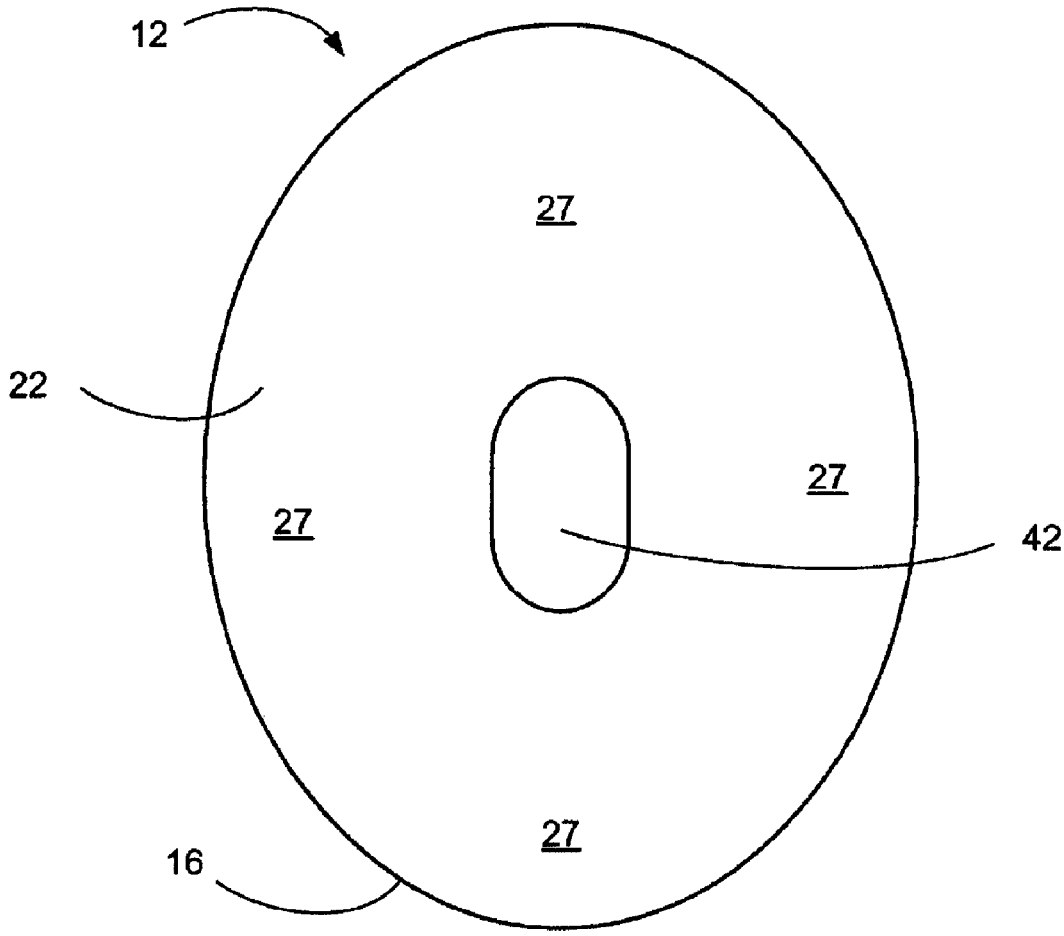
FIG. 3 is an inside plan view of an earphone.

FIG. 3 shows the a plan view of the earphone 12 of FIG. 2, The foam portion and the cushion cover 22 provide a substantially flat area 27 that seals against the ear of the user. The flat area 27 is sufficiently large so that the earphone provides a good seal against a wide variety of different ear shapes, sizes, and contours. The earphone cushion 16 and the opening 42 have an elongated shape, such as an oval shape or a "racetrack" (two semicircles connected by substantially straight lines) shape. The oval or racetrack shapes match the typical shape of the human ear and the concha better than do earphones having circularly shaped openings.

Numerous uses of and departures from the specific apparatus and techniques disclosed herein may be made without departing from the inventive concepts. Consequently, the invention is to be construed as embracing each and every novel feature and novel combination of features disclosed herein and limited only by the spirit and scope of the appended claims.

What is claimed is:

1. Apparatus comprising:

an earphone, comprising:

a generally planar baffle having two surfaces, with an opening therethrough;

a first enclosed volume portion, comprising the first baffle surface;

a foam structure having two generally planar surfaces and sides and an opening therethrough, the opening having two ends, the first planar surface of the foam structure mounted against the first baffle surface so that the baffle opening is adjacent the first end of the cushion opening, wherein the foam structure opening is acoustically coupled to the foam structure; and a cushion cover of acoustically closed material, covering the second planar surface of the foam structure, except for the second end of the cushion opening; and a second enclosed volume portion, comprising the second baffle surface; and a cup-shaped shell;

wherein the cushion cover is constructed and arranged to contact the external portion of a user's ear and to conform to features of the external portion of a user's ear so that the cushion seals against the user's ear without contact to the side of the head of the user.

2. Apparatus in accordance with claim 1, further comprising an acoustic driver, mounted in the baffle opening.

3. Apparatus in accordance with claim 1, wherein the volumetric dimension of the cushion passageway is less than 10 cc.

4. Apparatus in accordance with claim 3, wherein the volumetric dimension of the cushion passageway is about 5 cc.

5. Apparatus in accordance with claim 3, wherein the volumetric dimension of the foam structure is about 20 cc.

6. Apparatus in accordance with claim 1, wherein the rear enclosed volume portion is acoustically coupled to the environment by an acoustic volume and an acoustic resistance in parallel.

7. Apparatus in accordance with claim 1, wherein the foam structure opening has an elongated shape in cross section.

8. Apparatus in accordance with claim 7, wherein the foam structure opening has a racetrack shape in cross section.

9. Apparatus in accordance with claim 1, wherein the foam structure planar surfaces have an elongated shape.

10. Apparatus in accordance with claim 9, wherein the foam structure planar surfaces have an oval shape.

* * * * *